US011535418B2

(12) United States Patent
Padilla

(10) Patent No.: US 11,535,418 B2
(45) Date of Patent: Dec. 27, 2022

(54) TWISTED PACKAGES AND BLANKS THEREFOR

(71) Applicant: WestRock Shared Services, LLC, Atlanta, GA (US)

(72) Inventor: Jesus A. Padilla, Hoschton, GA (US)

(73) Assignee: WestRock Shared Services, LLC, Atlanta, GA (US)

( * ) Notice: Subject to any disclaimer, the term of this patent is extended or adjusted under 35 U.S.C. 154(b) by 0 days.

(21) Appl. No.: 17/105,179

(22) Filed: Nov. 25, 2020

(65) Prior Publication Data

US 2021/0155363 A1 May 27, 2021

Related U.S. Application Data

(60) Provisional application No. 62/940,403, filed on Nov. 26, 2019.

(51) Int. Cl.
*B65D 5/02* (2006.01)
*B65D 5/42* (2006.01)

(52) U.S. Cl.
CPC ..... *B65D 5/029* (2013.01); *B65D 5/4266* (2013.01)

(58) Field of Classification Search
CPC ..... B65D 5/06; B65D 5/067; B65D 5/0209; B65D 5/029; B65D 5/4266
USPC ..... 229/106, 108, 115, 116, 116.1, 108.1, 229/213; 206/822; 446/488
See application file for complete search history.

(56) References Cited

U.S. PATENT DOCUMENTS 1,509,735 A * 9/1924 Laubersheimer ..... B65D 5/10 229/185
2,047,804 A * 7/1936 Shapiro ..... B65D 5/06 229/138
3,354,924 A * 11/1967 Birrell ..... B65D 1/18 220/666
3,369,727 A * 2/1968 Wright ..... B65D 5/745 229/117.12
3,912,156 A * 10/1975 May ..... B65D 5/12 229/4.5
4,147,279 A * 4/1979 Matsui ..... B65D 37/00 220/666
4,191,324 A * 3/1980 Kitagawa ..... B65D 5/3607 229/104
5,762,262 A * 6/1998 Martin ..... B65D 5/36 229/120.21
5,819,453 A * 10/1998 Eichert ..... G09F 15/0062 40/411

(Continued)

FOREIGN PATENT DOCUMENTS

DE 19921800 A1 * 11/2000 ..... B65D 5/029
DE 202004011148 U1 * 10/2004 ..... B65D 5/0209
FR 1142822 A * 9/1957

(Continued)

*Primary Examiner* — Christopher R Demeree
*Assistant Examiner* — Phillip D Schmidt
(74) *Attorney, Agent, or Firm* — Brian J. Goldberg

(57) ABSTRACT

In accordance with at least one aspect of this disclosure, a twisted package can be configured to be flat in a collapsed state having one or more fold lines that are straight. At least a portion of the twisted package can be twisted in the formed state such that the one or more fold lines are bent in the formed state and/or such that a body of the twisted package is twisted in a formed state. Any suitable structure to form a twisted package is contemplated herein.

16 Claims, 5 Drawing Sheets

(56) References Cited

U.S. PATENT DOCUMENTS

| | | | | |
|---|---|---|---|---|
| 2007/0138242 | A1* | 6/2007 | Fitzwater | B65D 5/029<br>229/152 |
| 2018/0118405 | A1* | 5/2018 | Walling | B65D 5/443 |

FOREIGN PATENT DOCUMENTS

| | | | | |
|---|---|---|---|---|
| FR | 1355671 | A * | 3/1964 | |
| GB | 716692 | A * | 10/1954 | B65D 5/029 |

* cited by examiner

TWISTED PACKAGES AND BLANKS THEREFOR

CROSS-REFERENCE TO RELATED APPLICATIONS

This application claims priority to and the benefit of U.S. Provisional Application No. 62/940,403, filed Nov. 26, 2019, the entire contents of which are herein incorporated by reference in their entirety.

FIELD

This disclosure relates to packages and blanks therefor.

BACKGROUND

Packages can include basic boxes having straight sides, for example. More exotic shapes are desired.

Such conventional methods and systems have generally been considered satisfactory for their intended purpose. However, there is still a need in the art for improved packages. The present disclosure provides a solution for this need.

SUMMARY

In accordance with at least one aspect of this disclosure, a twisted package can be configured to be flat in a collapsed state having one or more fold lines that are straight. At least a portion of the twisted package can be twisted in the formed state such that the one or more fold lines are bent in the formed state and/or such that a body of the twisted package is twisted in a formed state. Any suitable structure to form a twisted package is contemplated herein.

In certain embodiments, the twisted package can include a body defining a pouch cavity in the formed state and having a first end and a second end, the body comprising a first longitudinal fold line, a second longitudinal fold line, at third longitudinal fold line, and a fourth longitudinal fold line, each extending a length of the body. Any other suitable number of longitudinal lines are contemplated herein.

The twisted package can include a plurality of first end bridges connected to the body via one or more first bridge fold lines and formed between the second longitudinal fold line and fourth longitudinal fold line. The first and third longitudinal fold lines can continue from the body into a center of each first end bridge, respectively.

The twisted package can include a plurality of second end bridges connected to the body via one or more second bridge fold lines and formed between the first longitudinal fold line and third longitudinal fold line. The second and fourth longitudinal fold lines can continue from the body into a center of each second end bridge, respectively.

The twisted package can include a plurality of first end panels connected to the first end bridges and configured to enclose the pouch cavity at the first end. The twisted package can include a plurality of second end panels connected to the second end bridges and configured to enclose the pouch cavity at the second end.

The first, second, third, and fourth longitudinal fold lines can be twisted in the formed state, for example. Any other number of twisted longitudinal fold lines in the formed state are contemplated herein.

The twisted package can include a first end assembly connected to the first end bridges at one or more first end assembly fold lines and configured to enclose the second end. The first end assembly can be configured to latch together to allow the first end to be selectively enclosable by a user.

The twisted package can include a second end assembly connected to the second end bridges at one or more second end assembly fold lines. The second end assembly can include a plurality of second end panels adhered together to form a planar shape.

The first end assembly substantially can define a first plane and the second end assembly can substantially defines a second plane. The first plane and the second plane can be non-coplanar such that the body is twisted when the first assembly is enclosing the first end and when the second assembly is enclosing the second end, for example.

In accordance with at least one aspect of this disclosure, a blank can be configured to form any suitable embodiment of a twisted package as disclosed herein (e.g., as described above). In accordance with at least one aspect of this disclosure, certain embodiments of a blank configured to form a twisted package (e.g., any suitable embodiment disclosed herein) can include a plurality of parallelogram body panels each connected by one or more longitudinal fold lines.

The blank can include a plurality of first end triangle panels connected at a first end of each parallelogram body panel at a fold line between a respective body panel and a respective first end triangle panel, each first end triangle panel being connected to an adjacent first end triangle panel at a common longitudinal fold line. The blank can include a plurality of second end triangle panels connected at a second end of each parallelogram body panel at a fold line between a respective body panel and a respective second end triangle panel, each second end triangle panel being connected to an adjacent second end triangle panel at a common longitudinal fold line.

The blank can include a plurality of first end panels, one of the plurality of first end panels extending from each first end triangle panel, the plurality of first end panels configured to be mated together to enclose the first end. The blank can include a plurality of second end panels, one of the plurality of second end panels extending from each second end triangle panel, the plurality of second end panels configured to be mated together to enclose the second end.

In certain embodiments, the blank can include a body connector tab panel extending laterally from a first parallelogram body panel of the plurality of parallelogram body panels and configured to be attached to a last body panel of the plurality of parallelogram body panels. The blank can include one or more second end triangle panel connector tab panels extending laterally from an initial second end triangle body panel of the plurality of second end triangle panels and configured to be attached to a last second end triangle panel of the plurality of second end triangle panels.

In certain embodiments, the first end panels can include a cut line between each first end panel. A first first end panel pair can include an angle cut line and a second first end panel pair includes a straight vertical cut line, for example. The second end panels can include a fold line between each end panel.

In certain embodiments, a center longitudinal fold line can be or include a perforated line. Any other suitable line types for any line disclosed herein is contemplated herein.

Certain embodiments can include adhesive disposed on the body connector tab panel and the second end triangle connector panel. Any suitable adhesive can be applied to any suitable panel disclosed herein for any suitable purpose.

These and other features of the embodiments of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1:
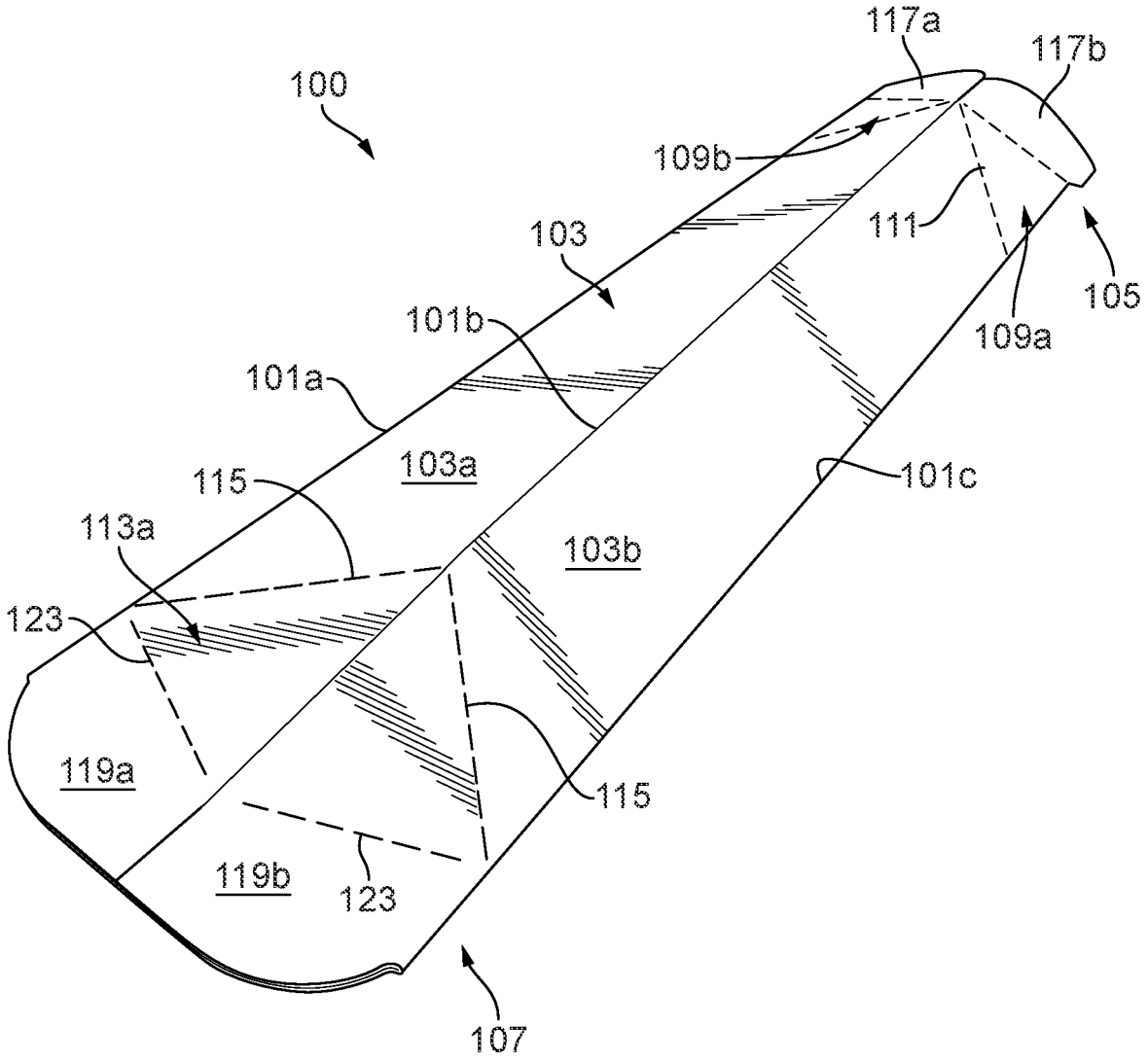
FIG. 1 is a perspective view of an embodiment of a twisted package in accordance with this disclosure, shown in a partially collapsed untwisted state.

Reference will now be made to the drawings wherein like reference numerals identify similar structural features or aspects of the subject disclosure. For purposes of explanation and illustration, and not limitation, an illustrative view of an embodiment of a twisted package in accordance with the disclosure is shown in FIG. 1 and is designated generally by reference character 100. Other embodiments and/or aspects of this disclosure are shown in FIGS. 2-5. Certain embodiments described herein can be used for packaging, for example.

Figure 2:
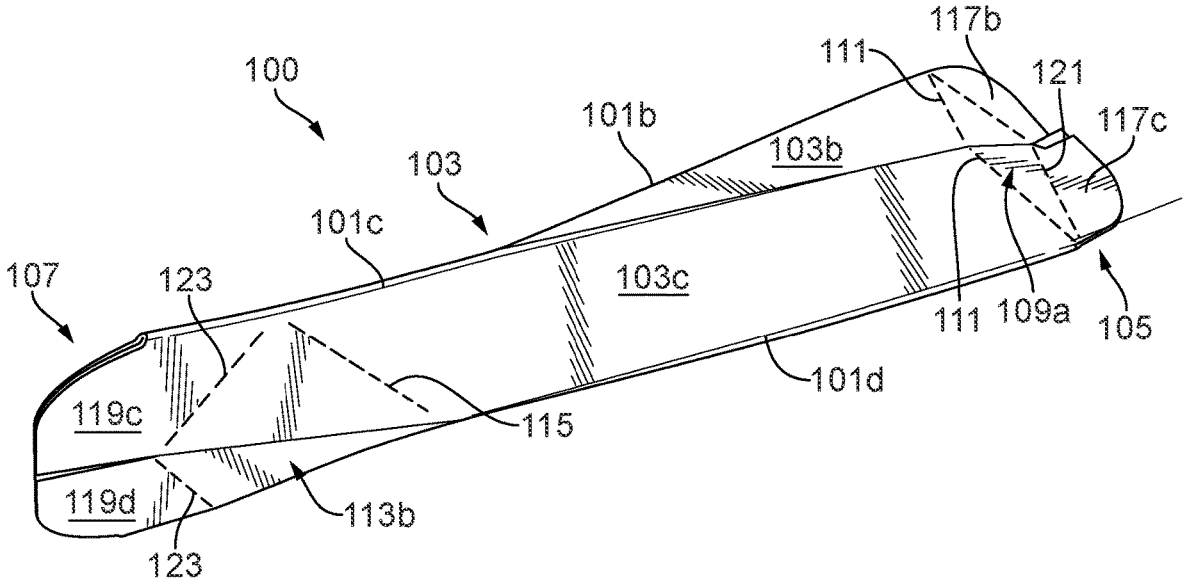
FIG. 2 is a first end perspective view of an embodiment of FIG. 1, shown in a formed state.
Figure 3:
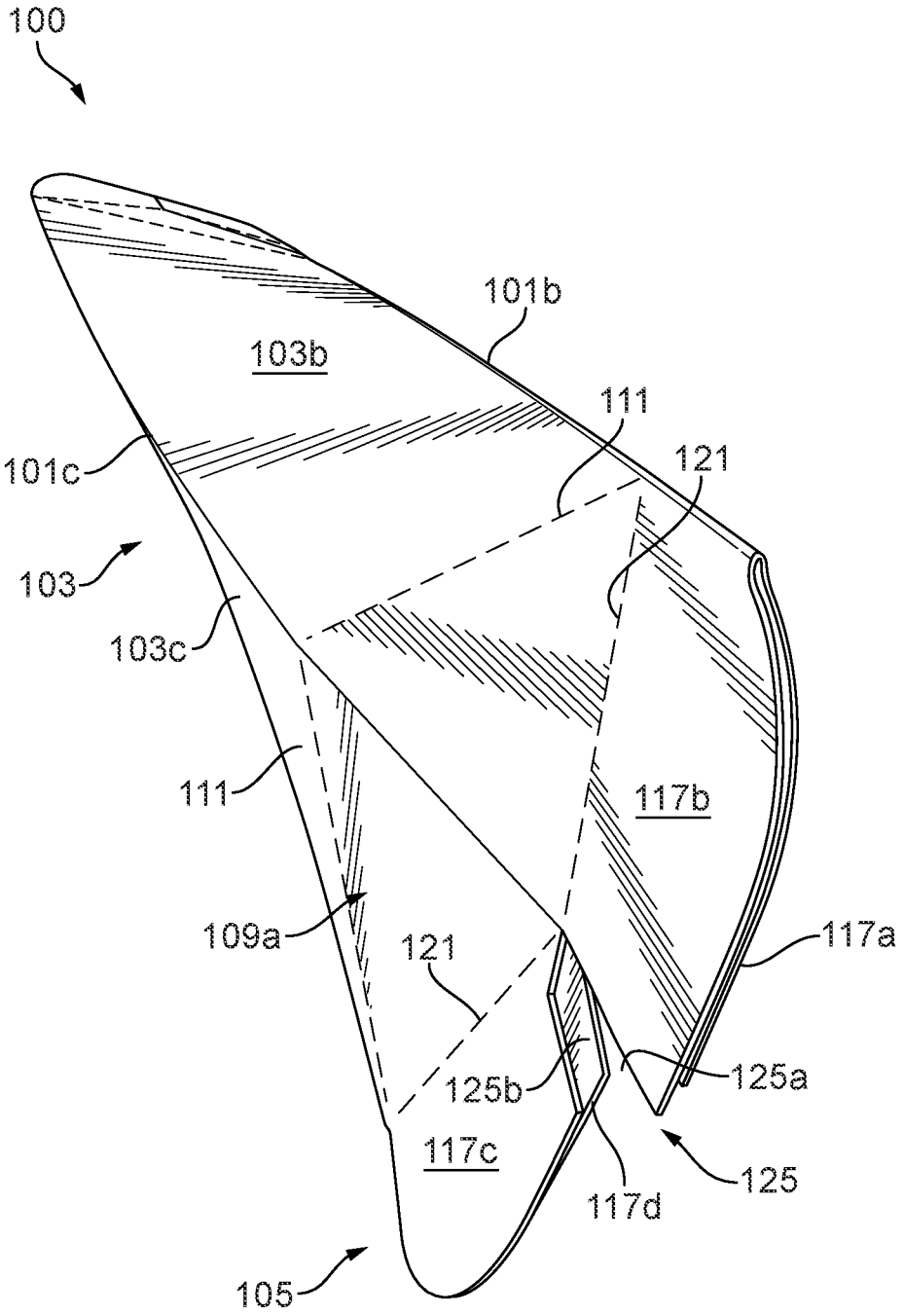
FIG. 3 is a second end perspective view of an embodiment of FIG. 1, shown in the formed state.
Figure 4:
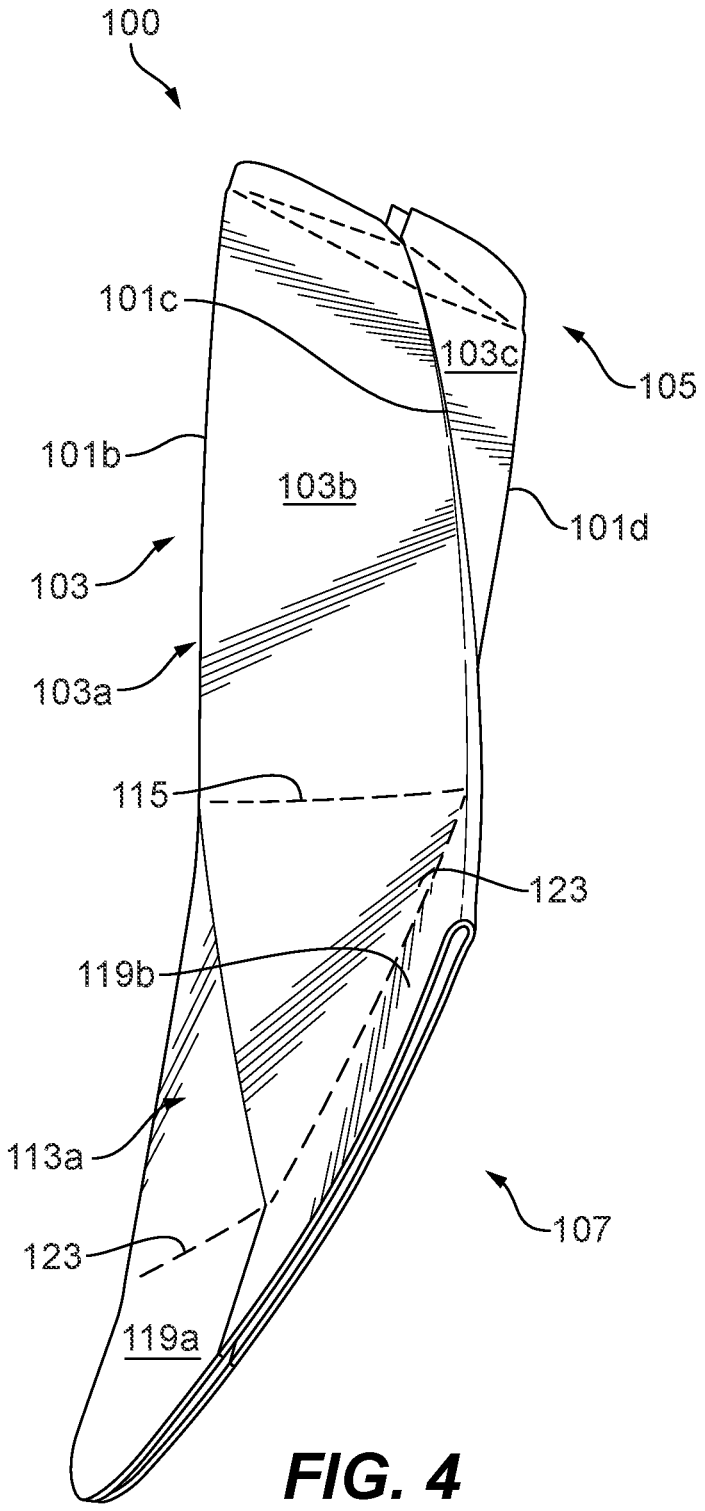
FIG. 4 is a perspective view of the embodiment of FIG. 1, shown in a formed state.
Figure 5:
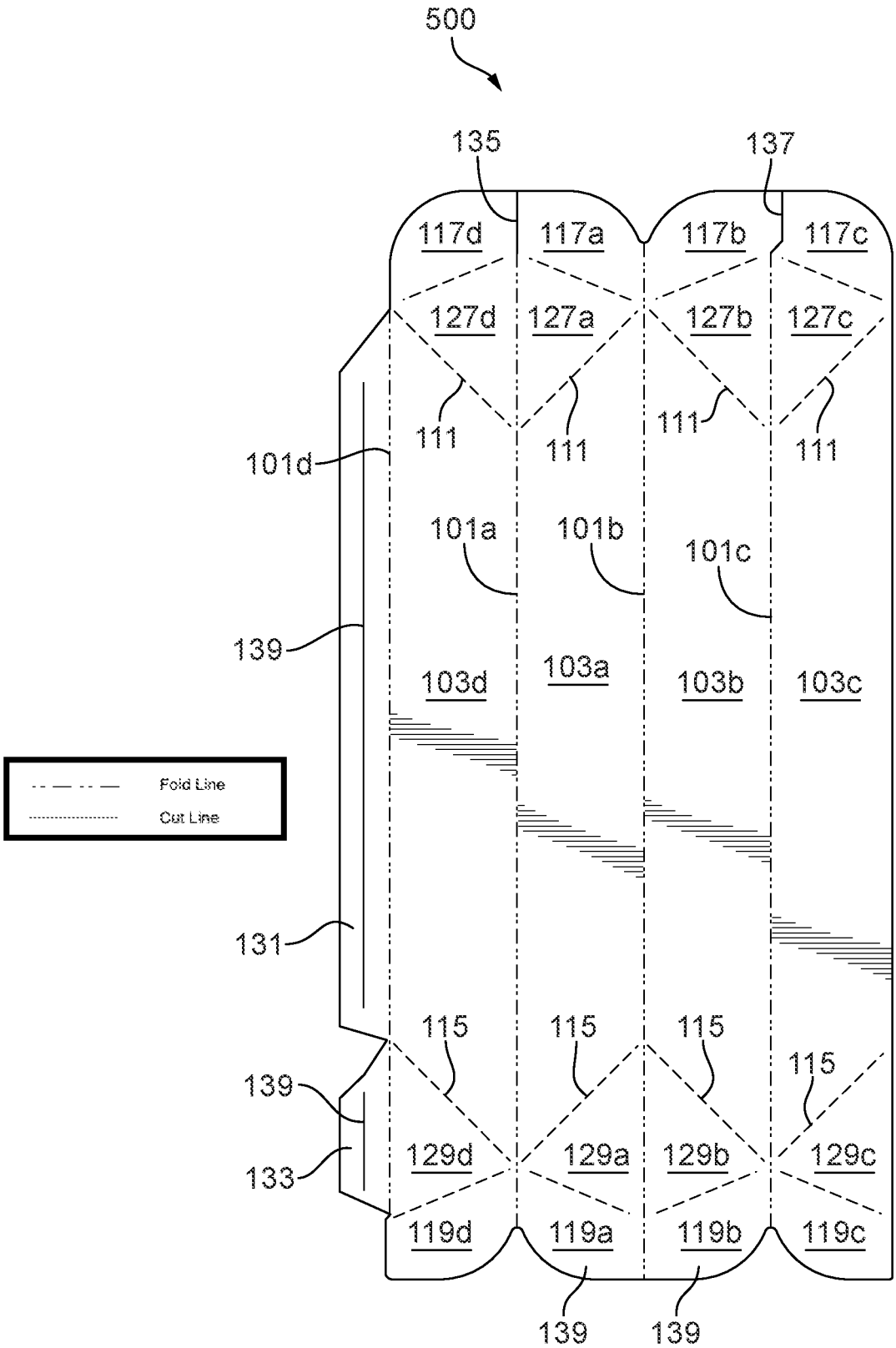
FIG. 5 is a plan view of an embodiment of blank in accordance with this disclosure.

In accordance with at least one aspect of this disclosure, referring to FIGS. 1-4, and particularly to FIG. 1, a twisted package 100 (e.g., a pouch) can be configured to be flat in a collapsed state (e.g., as partly shown in FIG. 1, which is a partially collapsed untwisted state) having one or more fold lines 101*a, b, c, d* that are straight. Referring specifically to FIGS. 2, 3, and 4, at least a portion of the twisted package 100 can be twisted in the formed state (e.g., as shown in FIG. 2) such that the one or more fold lines 101*a, b, c, d* are bent in the formed state and/or such that a body 103 of the twisted package is twisted in a formed state. Any suitable structure to form a twisted package (e.g., 100) is contemplated herein.

In certain embodiments, the twisted package 100 can include a body 103 defining a pouch cavity in the formed state. The twisted package 100 can include a first end 105 and a second end 107. The body 103 can include a first longitudinal fold line 101*a*, a second longitudinal fold line 101*b*, at third longitudinal fold line 101*c*, and a fourth longitudinal fold line 101*d*, each extending a length of the body 103. The longitudinal fold lines 101*a, b, c, d*, can extend any other suitable distance. Any other suitable number of longitudinal lines are contemplated herein.

The twisted package 100 can include a plurality of first end bridges 109 connected to the body 103 via one or more first bridge fold lines 111 and formed between the second longitudinal fold line 101*b* and fourth longitudinal fold line 101*d*. The first and third longitudinal fold lines 101*a*, 101*c* can continue from the body 103 into a center of each first end bridge 109*a*, 109*b*, respectively, e.g., as shown.

The twisted package 100 can include a plurality of second end bridges 113*a*, 113*b* connected to the body 103 via one or more second bridge fold lines 115 and formed between the first longitudinal fold line 101*a* and third longitudinal fold line 101*c*. The second and fourth longitudinal fold lines 101*b*, 101*d* can continue from the body 103 into a center of each second end bridge 113*a*, 113*b*, respectively, e.g., as shown.

The twisted package 100 can include a plurality of first end panels 117*a*, 117*b*, 117*c*, 117*d* connected to the first end bridges 109*a*, 109*b* and configured to enclose the pouch cavity at the first end 105. The twisted package 100 can include a plurality of second end panels 119*a, b, c, d*, connected to the second end bridges 113*a*, 113*b* and configured to enclose the pouch cavity at the second end 107.

The first, second, third, and fourth longitudinal fold lines 101*a, b, c, d* can be twisted in the formed state, for example. One or more body panels 103*a, b, c, d* can be twisted in the formed state (e.g., regardless of whether the one or more fold lines 101*a, b, c, d* are twisted or straight in the formed state). Any other number of twisted longitudinal fold lines or components of the twisted package in the formed state are contemplated herein.

The twisted package 100 can include a first end assembly (e.g., the plurality of first end panels 117*a, b, c, d*) connected to the first end bridges 109*a*, 109*b* at one or more first end assembly fold lines 121 and configured to enclose the second end. The first end assembly can be configured to latch together (e.g., using a latch 125 formed by the plurality of first end panels 117*a, b, c, d*) to allow the first end 105 to be selectively enclosable by a user, for example. For example, the latch 125 can include an overhanging lip 125*a* from a first end panel (e.g., 117*b* as shown) that can be pushed past an engagement tab 125*b* as shown to interfere together and/or clasp the first end 105 closed. Any suitable type of engagement system for the end assembly is contemplated herein.

The twisted package 100 can include a second end assembly (e.g., an assembly of second end panels 119*a, b, c, d*) connected to the second end bridges 113*a, b, c, d* at one or more second end assembly fold lines 123. The second end assembly can include a plurality of second end panels 119*a, b, c, d* adhered together (e.g., in pairs using any suitable adherent, glue, tack, mechanical connection, etc.), for example, to form a substantially planar shape.

In certain embodiments, the first end assembly substantially can define a first plane and the second end assembly can substantially defines a second plane. The first plane and the second plane can be non-coplanar such that the body 103 is twisted when the first end assembly is enclosing the first end 105 and when the second end assembly is enclosing the second end 107, for example.

In accordance with at least one aspect of this disclosure, a blank can be configured to form any suitable embodiment of a twisted package (e.g., 100) as disclosed herein (e.g., as described above). In accordance with at least one aspect of this disclosure, certain embodiments of a blank 500 configured to form a twisted package (e.g., 100 or any other suitable embodiment disclosed herein) can include a plurality of parallelogram body panels 103*a, b, c, d* each connected by one or more longitudinal fold lines 101*a, b, c* (and fold line 101*d* when formed). The body panels 103*a, b, c, d* can include any other suitable shape (e.g., a non-parallelogram shape).

The blank 500 can include a plurality of first end triangle panels 109*b* connected at a first end of each parallelogram body panel 103*a, b, c, d* at a fold line 111 between a respective body panel 103*a, b, c, d* and a respective first end triangle panel 127*a, b, c, d*. Each first end triangle panel 127*a, b, c, d* can be connected to an adjacent first end triangle panel 127*a, b, c, d* (e.g., 127*a* and 127*d*, as well as 127*b* and 127*c*) at a common longitudinal fold line (e.g., fold lines 101*a* and 101*c* as shown).

The blank 500 can include a plurality of second end triangle panels 129*a, b, c, d* connected at a second end of each parallelogram body panel 103*a, b, c, d* at a fold line 115 between a respective body panel 103*a, b, c, d* and a respective second end triangle panel 129*a, b, c, d*. Each second end triangle panel 129*a, b, c, d* can be connected to an adjacent second end triangle panel 129*a, b, c, d* at a common longitudinal fold line (e.g., fold lines 101*b* and 101*d* as shown). It is contemplated that the first end triangle panels 127*a, b, c, d* and the second end triangle panels 129*a, b, c, d* can include the same triangle shape in different positions. For example, the first end triangle panels 127*a, b, c, d* and the second end triangle panels 129*a, b, c, d* can be non-equilateral triangles having a non-shortest side being defined by the fold lines 111 and 115. Any other suitable triangle shape for one or more of the panels 127*a, b, c, d* and 129*a, b, c, d* is contemplated herein. Any other suitable non-triangle shape for the panels 127*a, b, c, d* and 129*a, b, c, d* configured to form an end bridge (e.g., end bridges 109*a, b* and 113*a, b* as shown) from the panels 127*a, b, c, d* and 129*a, b, c, d* is contemplated herein.

In certain embodiments, the the first end triangle panels 127*a, b, c, d* and the second end triangle panels 129*a, b, c, d* can be disposed in a mirrored (e.g., about a lateral axis that is 90 degrees to the longitudinal fold lines 101*a, b, c, d*) and flipped (about a vertical axis defined parallel to the longitudinal fold lines 101*a, b, c, d*) relationship to each other as shown. Such an arrangement can allow for the twisting of the body 103 when formed. Any other suitable arrangement is contemplated herein.

The blank 500 can include a plurality of first end panels 117*a, b, c, d*. One of the plurality of first end panels 117*a, b, c, d*, can extend from each first end triangle panel 127*a, b, c, d*. The plurality of first end panels 117*a, b, c, d* can be configured to be mated together to enclose the first end 105 (e.g., mechanically).

The blank 500 can include a plurality of second end panels 119*a, b, c, d*. One of the plurality of second end panels 119*a, b, c, d* can extend from each second end triangle panel 129*a, b, c, d*. The plurality of second end panels 119*a, b, c, d* configured to be mated together (e.g., via an adhesive) to enclose the second end 107.

In certain embodiments, the blank 500 can include a body connector tab panel 131 extending laterally from a first parallelogram body panel 103*d* of the plurality of parallelogram body panels 103*a, b, c, d* and configured to be attached (e.g., flushly adhered) to a last body panel 103*c* of the plurality of parallelogram body panels 103*a, b, c, d* (e.g., such that an edge of panel 103*c* aligns with fold line 101*d*). The blank 500 can include one or more second end triangle panel connector tab panels 133 extending laterally from an initial second end triangle body panel 129*d* of the plurality of second end triangle panels 129*a, b, c, d* and configured to be attached (e.g., flushly adhered) to a last second end triangle panel 129*c* of the plurality of second end triangle panels 129*a, b, c, d* (e.g., such that an edge of panel 129*c* aligns with fold line 101*d*). In certain embodiments, the first end panels 117*a, b, c, d* can include a cut line 135, 137 between each first end panel 117*a, b, c, d*. A first first end panel pair (e.g., 117*b*, 117*c* as shown) can include an angle cut line 137 (e.g., including an at least partly angled line) and a second first end panel pair (e.g., 117*a*, 117*d* as shown) can include a straight vertical cut line 135, for example. The second end panels 119*a, b, c, d* can include a fold line (e.g., fold lines 101*a* and 101*c*) between each end panel pair (e.g., 119*d*, 119*a* and 119*b*, 119*c*).

In certain embodiments, a center longitudinal fold line (e.g., 101*b* as shown) can be or include a perforated line. Any other suitable line types for any line disclosed herein is contemplated herein.

Certain embodiments can include adhesive 139 (e.g., glue) disposed on the body connector tab panel 131 and the second end triangle connector panel 133. Any suitable adhesive can be applied to any suitable panel disclosed herein for any suitable purpose.

While embodiments have been described and shown above, any suitable panels and/or other design for a blank to form a twisted package is contemplated herein. Any suitable material for use (e.g., paper, cardboard, plastic board, etc.) is contemplated herein.

Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

The articles "a", "an", and "the" as used herein and in the appended claims are used herein to refer to one or to more than one (i.e., to at least one) of the grammatical object of the article unless the context clearly indicates otherwise. By way of example, "an element" means one element or more than one element.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of."

Any suitable combination(s) of any disclosed embodiments and/or any suitable portion(s) thereof are contemplated herein as appreciated by those having ordinary skill in the art in view of this disclosure.

The embodiments of the present disclosure, as described above and shown in the drawings, provide for improvement in the art to which they pertain. While the subject disclosure includes reference to certain embodiments, those skilled in the art will readily appreciate that changes and/or modifications may be made thereto without departing from the spirit and scope of the subject disclosure.

What is claimed is:

1. A twisted package configured to be flat in a collapsed state having one or more fold lines that are straight, wherein at least a portion of the twisted package is twisted in the formed state such that the one or more fold lines are bent in the formed state and/or such that a body of the twisted package is twisted in a formed state, the twisted package comprising:

a body defining a pouch cavity in the formed state and having a first end and a second end, the body comprising a first longitudinal fold line, a second longitudinal fold line, a third longitudinal fold line, and a fourth longitudinal fold line, each extending a length of the body to form parallelogram body panels;

a plurality of first end bridges formed by a plurality of first end triangle panels respectively connected to the body via one or more first bridge fold lines and formed between the second longitudinal fold line and fourth longitudinal fold line, wherein the first and third longitudinal fold lines continue from the body into a center of respective first end bridges;

a plurality of second end bridges formed by a plurality of second end triangle panels respectively connected to the body via one or more second bridge fold lines and formed between the first longitudinal fold line and third longitudinal fold line, wherein the second and fourth longitudinal fold lines continue from the body into a center of respective second end bridges;

a plurality of first end panels connected to the first end bridges and configured to enclose the pouch cavity at the first end; and a plurality of second end panels connected to the second end bridges and configured to enclose the pouch cavity at the second end.

2. The twisted package of claim 1, wherein the first, second, third, and fourth longitudinal fold lines are twisted in the formed state.

3. The twisted package of claim 1, wherein the plurality of first end panels form a first end assembly connected to the first end bridges at one or more first end assembly fold lines and configured to close off the first end.

4. The twisted package of claim 3, wherein the plurality of first end panels of the first end assembly are configured to latch together to allow the first end to be selectively enclosable by a user.

5. The twisted package of claim 3, wherein the plurality of second end panels form a second end assembly connected to the second end bridges at one or more second end assembly fold lines.

6. The twisted package of claim 5, wherein the plurality of second end panels of the second end assembly are adhered together to form a planar shape.

7. The twisted package of claim 5, wherein the first end assembly substantially defines a first plane, the second end assembly substantially defines a second plane, wherein the first plane and the second plane are neither coplanar nor parallel, such that the body is twisted when the first assembly is enclosing the first end and when the second assembly is enclosing the second end.

8. A blank configured to form a twisted package of any of the preceding claims.

9. A blank configured to form a twisted package, comprising:

a plurality of parallelogram body panels each connected by one or more longitudinal fold lines;

a plurality of first end triangle panels respectively connected to a first end of each parallelogram body panel at a fold line separating a respective body panel and a respective first end triangle panel, each first end triangle panel being connected at an edge thereof to an adjacent first end triangle panel along a common longitudinal fold line that forms the edge;

a plurality of second end triangle panels connected at a second end of each parallelogram body panel at a fold line between a respective body panel and a respective second end triangle panel, each second end triangle panel being connected to an adjacent second end triangle panel at a common longitudinal fold line;

a plurality of first end panels, one of the plurality of first end panels extending from each first end triangle panel, the plurality of first end panels configured to be mated together to enclose the first end; and a plurality of second end panels, one of the plurality of second end panels extending from each second end triangle panel, the plurality of second end panels configured to be mated together to enclose the second end.

10. The blank of claim 9, further comprising a body connector tab panel extending laterally from a first parallelogram body panel of the plurality of parallelogram body panels and configured to be attached to a last body panel of the plurality of parallelogram body panels.

11. The blank of claim 10, further comprising one or more second end triangle panel connector tab panels extending laterally from an initial second end triangle body panel of the plurality of second end triangle panels and configured to be attached to a last second end triangle panel of the plurality of second end triangle panels.

12. The blank of claim 11, wherein the first end panels include a cut line between each first end panel.

13. The blank of claim 12, wherein a first first end panel pair includes an angle cut line and a second first end panel pair includes a straight vertical cut line.

14. The blank of claim 13, wherein the second end panels include a fold line between each end panel.

15. The blank of claim 13, wherein a center longitudinal fold line can be or include a perforated line.

16. The blank of claim 15, further comprising adhesive disposed on the body connector tab panel and the second end triangle connector panel.

* * * * *